United States Patent [19]

Hopkinson

[11] 4,362,278

[45] Dec. 7, 1982

[54] ROLL DISPENSER

[76] Inventor: Linn L. Hopkinson, 515 Park Ave., Herkimer, N.Y. 13350

[21] Appl. No.: 236,736

[22] Filed: Feb. 23, 1981

[51] Int. Cl.[3] ..... B65H 19/04

[52] U.S. Cl. ..... 242/55.3; 242/55.53

[58] Field of Search ..... 242/55.3, 55.53; 225/34, 41, 46–50, 53, 54; 312/38–41

[56] References Cited

U.S. PATENT DOCUMENTS

| | | | |
|---|---|---|---|
| 2,592,346 | 4/1952 | Scogin | 242/55.3 |
| 2,924,494 | 2/1960 | Sloier | 312/39 |
| 2,959,368 | 11/1960 | Neff | 242/55.2 |
| 3,157,370 | 11/1964 | Govatsos et al. | 242/55.2 |
| 3,438,589 | 4/1969 | Jespersen | 242/55.2 |
| 3,500,667 | 3/1970 | Jespersen | 70/84 |
| 3,572,600 | 3/1971 | Jespersen | 242/55.3 |
| 3,865,295 | 2/1975 | Okamura | 225/47 |
| 4,142,431 | 3/1979 | Jespersen | 83/335 |

*Primary Examiner*—Leonard D. Christian

[57] ABSTRACT

A holder and dispenser for paper rolls or the like which has an unlocked cover that can be pivotally opened on a cabinet so that rolls can be inserted on spindles. The rolls are gravity fed into position by way of guiding tracks so that one roll is always in a dispensing position and at least one other is in a storage position. Pilfering is discouraged by way of spring-like lever arms positioned in the guiding tracks and the construction of the lower portion of the cabinet itself.

4 Claims, 3 Drawing Figures

ROLL DISPENSER

BACKGROUND OF THE INVENTION

1. Field Of The Invention

The present invention relates to a dispensing cabinet for paper rolls and more specifically to one which can accommodate a dispensing roll and at least one roll in a storage position ready to be gravity fed into position as a dispensing roll when the paper supply on the previous dispensing roll has been exhausted.

2. Description Of The Prior Art

Dispensers for tissue paper and paper toweling have been disclosed in the prior art. U.S. Pat. No. 2,959,368 entitled "Toilet Tissue Holder And Dispenser" discloses a unitary device adapted to rotatably hold a single roll of tissue being used while conveniently storing extra rolls in a vertical position. However, in order to replace the dispensing roll when it has been exhausted, it is necessary to open a cabinet door and place a new roll over a spindle so as to become a dispensing roll.

U.S. Pat. No. 3,157,370 entitled "Support Bracket For Toilet Paper Rolls" discloses a support bracket for two rolls of toilet paper. One problem not overcome by this invention is that an attendant must frequently replace the storage roll or it will not be in position to act as as reserve roll when the dispensing roll is exhausted.

U.S. Pat. No. 2,924,494 entitled "Towel Dispenser And Keyed Supply Roll" discloses a towel dispenser that requires any roll to have a keying passage which extends radially through the roll material.

U.S. Pat. No. 4,142,431 entitled "Reserve Roll Feed Mechanism For Dispenser For Flexible Sheet Material" discloses a dispenser that accommodates a reserve roll that is gravity fed into a dispensing position when a dispensing roll is almost exhausted. The invention discloses a very complex mechanism for performing this function.

SUMMARY OF THE INVENTION

The dispenser of the present invention provides a new and improved cabinet for retaining and dispensing rolls of paper e.g., toilet paper and paper towel rolls.

When most state of the art holders and dispensers require refilling it is necessary for maintenance personnel to unlock the holder and dispenser because the majority of such devices are incorporated with some type of locking mechanism in order to discourage pilferage.

It is accordingly an object of the invention to provide a novel and improved holder and dispenser for paper or the like that can eliminate the time consuming use of a lock and key to open prior art dispensing cabinets when they require filling.

A further object of the invention is to provide a novel and improved holder and dispenser for paper of the like that can eliminate the chance of pilferage by users of the holder and dispenser.

These and other objectives of the invention are accomplished in accordance with one aspect thereof by an enclosure utilizing a pair of guiding tracks and anti-pilfering means that allow storage rolls to be gravity fed into the position of a dispensing roll so as to eliminate the necessity of a key and locking mechanism.

BRIEF DESCRIPTION OF THE DRAWINGS

Various other objects, features and attendant advantages of the present invention will be more fully appreciated from the following detailed description when considered in connection with the accompanying drawings.

DESCRIPTION OF THE PREFERRED EMBODIMENT

Figure 1:
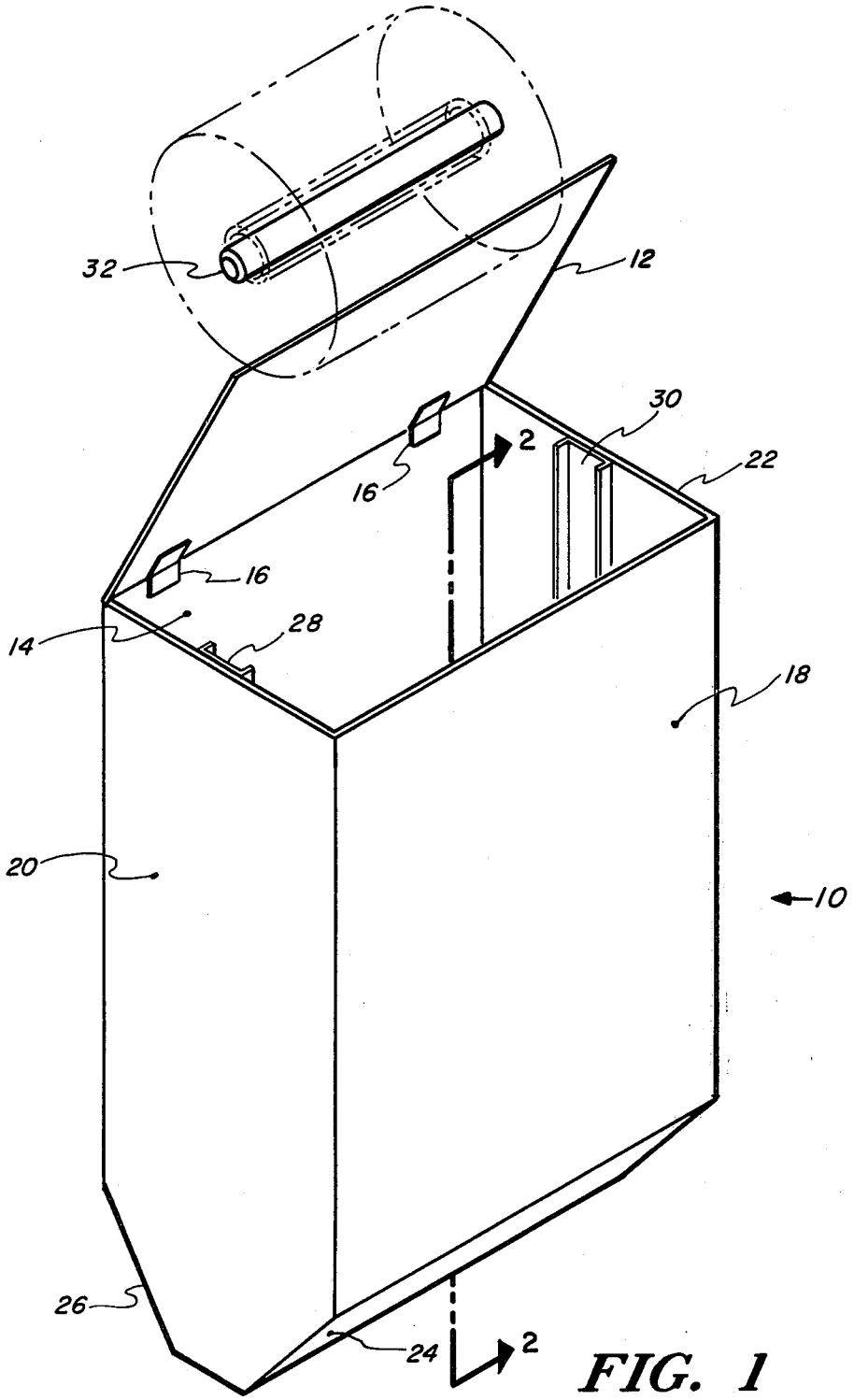
FIG. 1 is a perspective view of the holder and dispenser.
Figure 2:
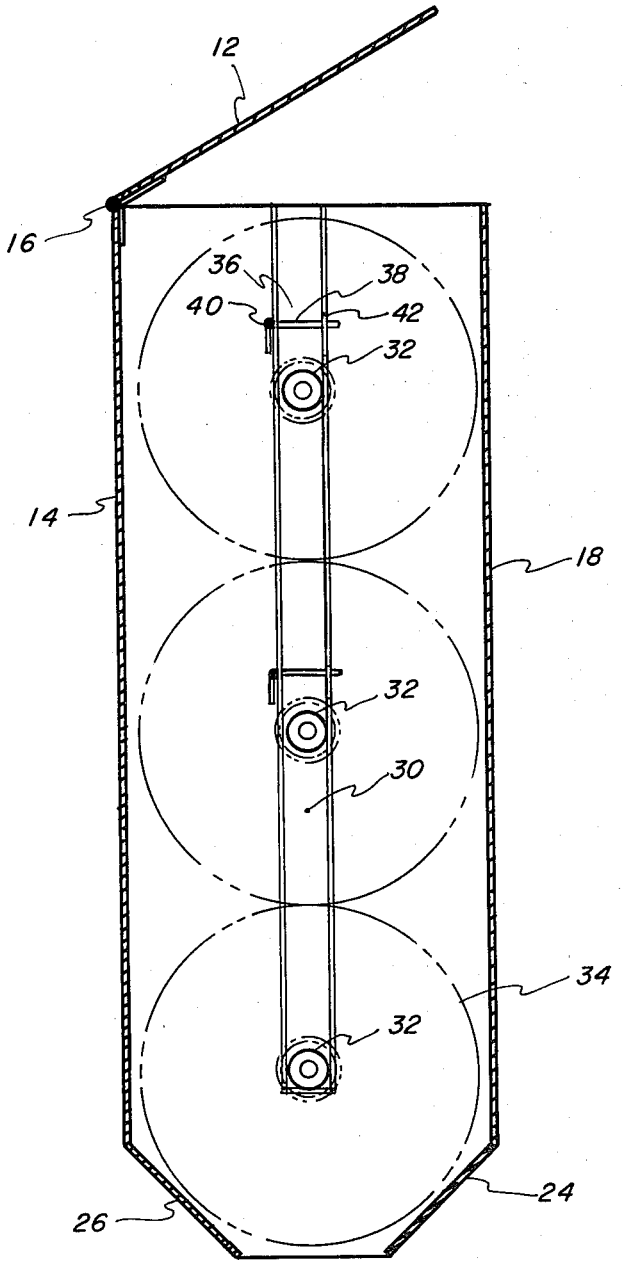
FIG. 2 is a cross sectional view of the holder and dispenser along the section lines 2—2 of FIG. 1.

With reference to FIG. 1, there is illustrated an isometric view of the present invention. A roll of paper can be inserted into cabinet 10 by lifting top door 12 that is pivotally mounted on backside 14 by pivot means 16. Cabinet 10 also is comprised of front side 18, left side 20 and right side 22. Bottom edges 24 and 26 function as an antipilfering means so that the dispensing roll cannot be removed from the bottom of cabinet 10 until most of the paper on said roll has been exhausted.

Left side 20 and right side 22 have a pair of guiding tracks 28 and 30 adapted so as to accommodate the end of spindle 32.

Guiding tracks 28 and 30 function as a guide means for the spindles of storage rolls so that they can eventually be gravity fed into position as a dispensing roll.

It is not necessary for guiding tracks 28 and 30 to be separate structures from left side 20 and right side 22 because they could be some type of grooved means within sides 20 and 22. However, they have been shown as separate structures in the drawings in order to more clearly illustrate their function.

Dispensing roll 34 is supported by means of the ends of spindle 32 of the dispensing roll coming in physical contact with the bottom end of guiding tracks 28 and 30.

Guiding tracks 28 and 30 each also have antipilfering means 36 which allow the ends of the spindles to pass by in one direction but not in another. This prevents theft of a storage roll by a person opening top door 12 and reaching for a storage roll in an effort to remove it from the top. Antipilfering means 36 can be realized in a variety of structures. An operational antipilfering means 36 can be constructed with an antipilfering arm 38 connected to spring 40 which is mounted on each side of guiding tracks 28 and 30. Spring 40 causes arm 38 to exert pressure on stop 42 so as to freely allow spindles to drop down but not allow them to be removed in an upward direction.

The use of the present invention will be readily apparent from a consideration of the foregoing. Briefly, cabinet 10 is installed on a wall or other suitable support by means of fastening apparatus such as screws.

Cabinet 10 is loaded by opening top door 12, inserting a spindle 32 through a roll of paper, and positioning the ends of said spindle within guiding tracks 28 and 30 so that it can drop to the dispensing position, passing through antipilfering means 36. As many storage rolls as can be accommodated within cabinet 10 can be dropped in the cabinet utilizing the same procedure.

Figure 3:
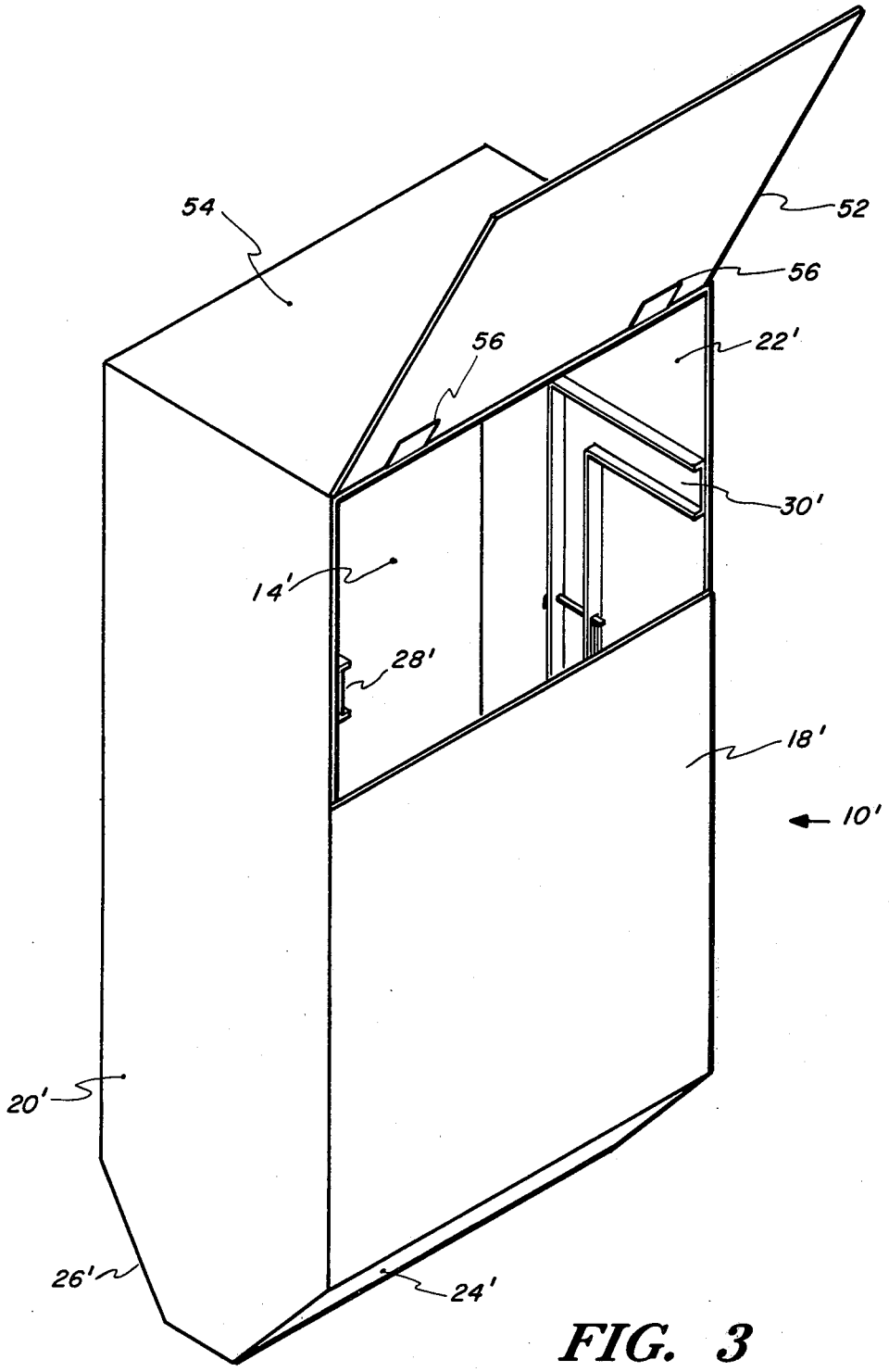
FIG. 3 is a perspective view of a second embodiment of the present invention showing the loading cover along the front face of the cabinet instead of on the top side of the cabinet.

Referring now to FIG. 3, there is shown an alternate embodiment of the present invention. Door 52 is pivotally mounted on top side 54 by means of hinging means 56. This embodiment shows that guiding tracks 28 and 30 do not have to be totally vertical as shown in FIGS.

1 and 2, but can be of any shape, even that shown in FIG. 3. Cabinet 10′ is loaded in an analogous manner as delineated for cabinet 10 whereby door 52 is opened, a spindle 32 inserted through a roll of paper with its ends positioned within guiding tracks 28′ and 30′. Once spindle 32 is inserted further into the guide means it will drop due to the force of gravity into the dispensing position. Storage rolls can then be inserted in a similar manner.

It should be stated that the diameter of the ends of spindles 32 can really be of any dimension matching the width of guiding tracks 28 and 30. As shown in the drawings the diameter of the ends of spindles 32 was approximately the same as the diameter of spindles 32 themselves. There is no reason why the width of guiding tracks 28 and 30, and the diameter of the ends of spindles 32 cannot be smaller than the diameter of spindles 32.

While two preferred embodiments of the invention have been shown and described, various other embodiments and modifications thereof will become apparent to persons skilled in the art, and will fall within the scope of the invention as defined in the following claims.

I claim:

1. A holder and dispenser for a dispensing roll of paper and at least one storage roll of paper comprising:

a generally hollow cabinet having a backside, a front side, a right side and a left side;

a pair of supporting means located on said left side and said right side of said hollow cabinet, said supporting means providing support for a cylindrical core of said dispensing roll of paper;

a cover means pivotally mounted on a top end of said cabinet and moveable between positions in which said top end is normally covered and uncovered for selective insertion of a roll of paper;

a guide means operatively connected to said right side and said left side of said cabinet for guiding a cylindrical core of a dispensing roll of paper to said supporting brackets and for guiding a cylindrical core of at least one storage roll of paper to be in a position over said dispensing roll so as to be gravity fed as a new dispensing roll as soon as a user has exhausted paper rolled on said dispensing roll and has removed the cylindrical core of said dispensing roll from said supporting means; and a first antipilfering means positioned within said guide means so as to prevent removal of a storage roll or a dispensing roll from said cover means.

2. The holder and dispenser as claimed in claim 1 further comprising:

a second antipilfering means positioned within said guide means so as to prevent removal of a dispensing roll from its position until a user has exhausted nearly all of the paper rolled on said dispensing roll.

3. The holder and dispenser as claimed in claim 1 or 2 wherein said guide means further comprises:

a guiding track at said right side and said left side so as to allow free gravity fed movement of said cylindrical cores of said storage rolls so that they can eventually be in a position to become a cylindrical core of a dispensing roll.

4. The holder and dispenser as claimed in claim 1 wherein said first antipilfering means is positioned within said guide means further comprising:

a spring retained along said guide means, said spring having a first end fixed to said guide means and a second end; and a lever arm having a first end and a second end, said first end of said lever arm being fixed to said second end of said spring, and said second end of said lever arm being held against a stop within said guide means so as to freely allow spindles to drop down but to restrict their movement in an upward direction.

* * * * *